US008266909B2

(12) United States Patent
Feller et al.

(10) Patent No.: US 8,266,909 B2
(45) Date of Patent: Sep. 18, 2012

(54) AIR VENT IN MAIN STEAM DUCT OF STEAM TURBINE

(75) Inventors: Gerald J. Feller, Orlando, FL (US); James C. Bellows, Maitland, FL (US); Teri J. Robertson, Satellite Beach, FL (US)

(73) Assignee: Siemens Energy, Inc., Orlando, FL (US)

( * ) Notice: Subject to any disclaimer, the term of this patent is extended or adjusted under 35 U.S.C. 154(b) by 814 days.

(21) Appl. No.: 12/420,908

(22) Filed: Apr. 9, 2009

(65) Prior Publication Data

US 2010/0257860 A1 Oct. 14, 2010

(51) Int. Cl.
*F01K 13/02* (2006.01)

(52) U.S. Cl. ..... 60/646; 60/657

(58) Field of Classification Search ..... 60/646, 60/657

See application file for complete search history.

(56) References Cited

U.S. PATENT DOCUMENTS

| | | | | |
|---|---|---|---|---|
| 3,220,193 | A * | 11/1965 | Strohmeyer, Jr. | 60/659 |
| 5,388,960 | A * | 2/1995 | Suzuki et al. | 415/176 |
| 6,213,059 | B1 * | 4/2001 | Gralton et al. | 122/1 B |
| 6,298,654 | B1 | 10/2001 | Vermes et al. | |
| 6,898,935 | B2 * | 5/2005 | Barber et al. | 60/646 |
| 6,918,253 | B2 | 7/2005 | Fassbender | |
| 7,043,920 | B2 | 5/2006 | Viteri et al. | |
| 2005/0034445 | A1 * | 2/2005 | Radovich | 60/39.182 |
| 2008/0236616 | A1 | 10/2008 | Bloch | |

* cited by examiner

*Primary Examiner* — Hoang Nguyen

(57) ABSTRACT

A power plant including a steam turbine, and a steam turbine exhaust duct configured to deliver uncontaminated fluid from the steam turbine to downstream components of the power plant. The steam turbine exhaust duct includes a steam turbine exhaust duct isolation valve selectively configured to prevent fluid communication between the steam turbine exhaust duct and the downstream components of the power plant, and a steam turbine exhaust duct vent with a steam turbine exhaust duct vent valve. The steam turbine exhaust duct vent is configured to deliver contaminated fluid from the steam turbine exhaust duct to a fluid sink upon opening of the exhaust duct vent valve.

8 Claims, 3 Drawing Sheets

AIR VENT IN MAIN STEAM DUCT OF STEAM TURBINE

FIELD OF THE INVENTION

This invention relates generally to power plants. More specifically, this invention relates to a method and apparatus for preventing contaminants from becoming entrained with the working fluid within a steam power plant.

BACKGROUND OF THE INVENTION

Steam turbine power generation plants utilize the energy present in a working medium at high pressure to turn a turbine, which, in turn, turns a generator, generating electrical energy. The working fluid must be free of particulate debris in order to prevent blockages within the system. The chemistry of the working fluid must also be closely monitored and controlled to eliminate harmful soluble contaminants which, if present in the working fluid, may deposit on internal components, possibly damaging those components over time.

During operation of the steam turbine power generation plant the particulate debris may be continually removed from the working fluid via filters etc, and the chemistry of the working fluid may be continually kept within tolerance using continuous treatment techniques such as condensate polishing. However, during periods when the power plant is not operating, such as prior to its first use, or during a scheduled shut down, these contaminants may not be continually removed from the working fluid. If a power plant were to be started-up without regard to a possible build up of these contaminants, the contaminants could overwhelm the continuous treatment techniques in place within the power plant, and cause damage to the components of the power plant.

Techniques for eliminating any built up debris have been developed. One of the simpler methods includes simply generating steam using existing working fluid and possibly adding new, chemically appropriate fluid to the working fluid, exhausting that steam to the atmosphere until the level of particulate debris reaches acceptable limits, and then using that steam to flush the rest of the system until the steam and condensate reach acceptable limits for particulate and chemical contaminants. At that point the working fluid is acceptable for use and the power plant can be brought online. However, this type of purging method may take up to several days, and consume hundreds of thousands of gallons of high quality working fluid.

Some power generation plants are peaking, or ready-reserve power plants, which produce power only during peak demand periods. This requires steam turbine power plants that can come online quickly, as demand changes. Thus, fast start-up times are imperative for such a system. Peaking steam turbine power generation plants, such as the FlexPlant™ 10 power generation plant, may employ a condenser where the operating pressure in the condenser is above ambient pressure. Conventional methods for treatment of working fluids, such as condensate polishing, may enable a sufficiently fast start-up time in conventional power plants, but in a positive pressure condenser power plant, the associated high temperature of the condensate renders the usual polishing process ineffective. Thus, in order to permit the use of condensate polishing, the condensate must be cooled, which reduces operating efficiency. Consequently, other methods of treating the condensate have been developed.

Positive pressure condenser power plants may inject pressure maintaining fluid, for example nitrogen, or other suitable gas, into the condenser to help maintain positive pressure in the condenser during shutdown, to prevent the entry into the system of contaminant containing atmospheric air during shutdown. A positive pressure condenser system is disclosed in U.S. patent application Ser. No. 12/366,763, filed Feb. 6, 2009, entitled CONDENSER SYSTEM, by James C. Bellows, the entire disclosure of which is incorporated herein by reference. Positive pressure condenser power plants may also use a pressure maintaining fluid, such as a nitrogen blanket, to fill the interior areas of the condenser (Air Cooled Heat Exchanger: "ACHE"), the high pressure boiler, and the main steam system, during periods of shutdown, in order to prevent contaminant containing atmospheric air from entering these components, and subsequently becoming entrained with the working fluid contained in the interior regions of those components. However, the interior of the steam turbine itself and steam exhaust duct between the steam turbine and condenser may not be blanketed with this pressure maintaining fluid so that, for instance, humans may enter and perform required maintenance. Instead, contaminant containing atmospheric air may be left in these interior areas, and an air dryer is used to help minimize moisture and corrosion.

BRIEF DESCRIPTION OF THE DRAWINGS

The invention is explained in the following description in view of the drawings that show.

DETAILED DESCRIPTION OF THE INVENTION

Figure 1:
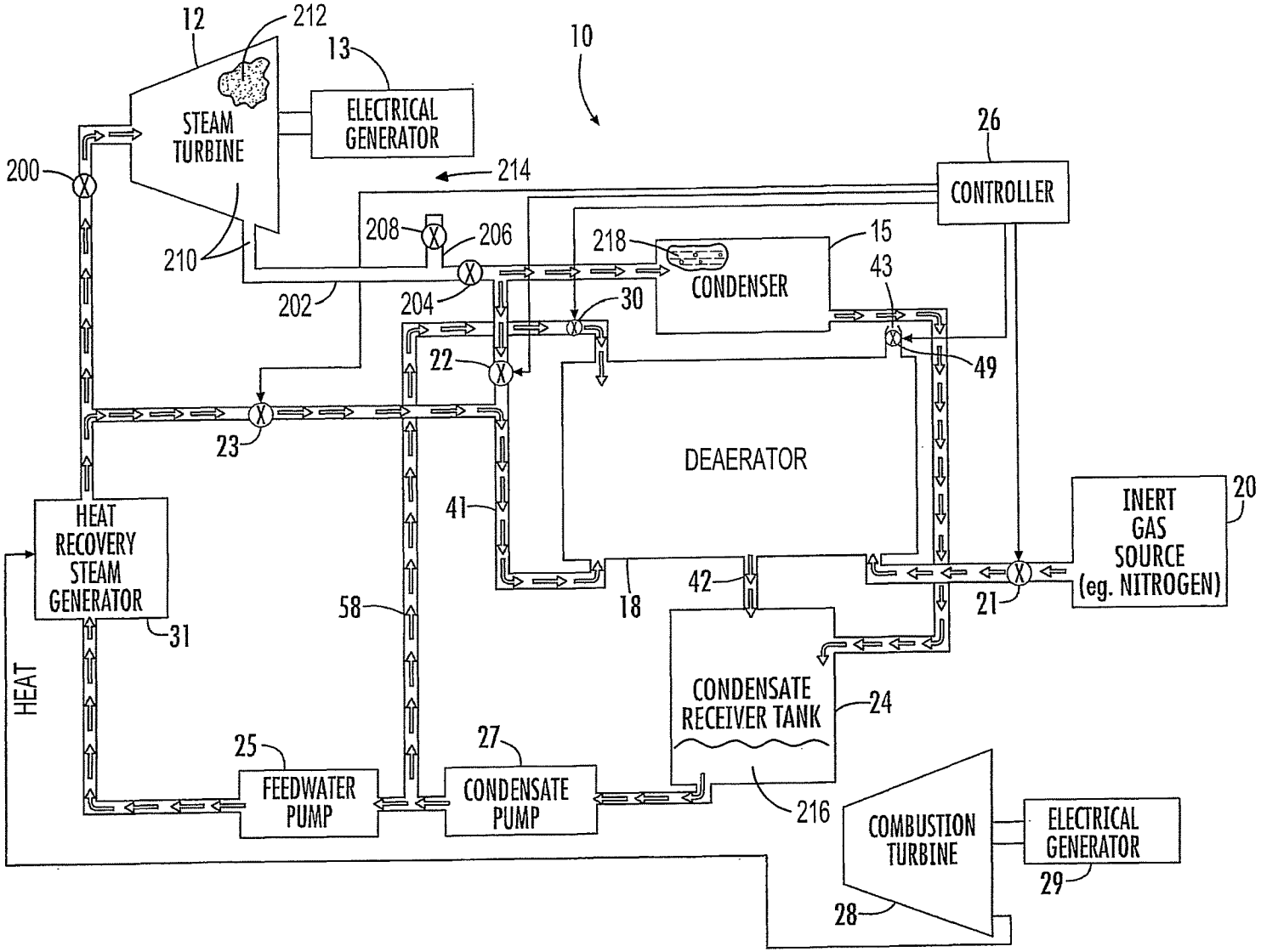
FIG. 1 is a diagrammatic illustration of a positive pressure condenser steam generating system incorporating an embodiment of the invention.

The present inventors have recognized that when certain steam turbine power plants are started-up, such as those that include large steam turbine exhaust ducts, or those with positive pressure condensers, contaminate introducing fluid ("contaminated fluid"), usually air, present in the interior areas of the power plant which were not blanketed with a pressure maintaining fluid, may become entrained with the other fluid present in the other components of the power plant. The other fluid may include the working fluid for generating power, the pressure maintaining fluid, for example, nitrogen, argon, helium, or neon gas, etc., or a combination of the working fluid and the pressure maintaining fluid. The entrainment of this contaminated fluid with the working fluid at start-up may add a significant amount of contaminants to the uncontaminated fluid at the precise time when efficient and fast removal of these contaminants is critical to enable fast start-up of the plant. For example, if air becomes entrained with the working fluid, the $CO_2$ present in the air will form carbonic acid within the power plant. The inventors have thus recognized the importance of preventing this contaminated fluid from becoming entrained with the uncontaminated fluid at start-up.

The inventors have developed an innovative, yet simple way to prevent this contaminated fluid from becoming entrained with the uncontaminated fluid. The inventors have added a vent and a vent valve to the steam turbine exhaust duct for selective and innovative venting of contaminated fluid. When it is desired to purge contaminated fluid from the interior areas of the steam turbine plant, for example upon start-up, the vent valve is opened for a period, and remains open as the steam is introduced into the steam turbine. Typically the period the vent valve is open is several seconds. The initial steam entering the turbine forces contaminated fluid out the vent. This purging continues until enough contaminated fluid is removed from the interior areas to reduce or eliminate contaminated fluid entrainment concerns. At this point the steam turbine isolation valve is opened and then the vent valve is closed, thus redirecting the steam to the condenser, permitting the completion of the remaining procedures for bringing the power plant online. In an embodiment, the vent valve may be on the order of a six inch valve, and an eighteen inch steam turbine isolation valve bypass is used to facilitate operation of the steam turbine isolation valve. As such, a steam turbine isolation valve bypass valve is opened before closing the vent valve, which permits the steam turbine isolation valve to open, after which the vent valve and steam turbine isolation valve bypass valve are closed. The inventors recognize that some, sacrificial uncontaminated fluid will be lost from the system during this purging, however the total volume lost is minimal. However, this invention reduces the need for chemical treatment of the working fluid during start-up, which is of paramount importance.

Further, the inventors recognize that this purging method could be used at times other than start-up of the power plant, when it becomes necessary to purge any contaminated fluid and/or working fluid as needed. The inventors have also recognized that this system and method of removing contaminated fluid is not limited to positive pressure condenser power plants, but can be applied to any steam power plant where there is a desire to remove contaminated fluid from the power plant, or a desire to prevent contaminated fluid from coming in contact with uncontaminated fluid.

Referring to FIG. 1, a positive pressure condenser steam power generation plant 10 is now described. The positive pressure condenser power generation plant shown includes a steam turbine 12; an electrical generator 13; a condenser 15; a deaerator 18; deaerator vent 43; an inert gas source 20; a condensate receiver tank 24; a condensate pump 27; a feedwater pump 25; a heat recovery steam generator 31; a controller 26; a combustion turbine 28; an electrical generator 29; valves 21, 22, 23, 30, and 49; and piping 41, 42, and 58. In addition, FIG. 1 shows a steam turbine isolation valve 200 located in the supply steam piping, upstream of the steam turbine 12. Steam turbine isolation valve 200 prevents fluid communication between the steam turbine exhaust duct and the downstream components of the power plant. Steam turbine exhaust duct 202 connects the steam turbine 12 to the condenser 15 and other downstream components of the power plant. Steam turbine exhaust duct isolation valve 204 isolates the contents of the steam turbine exhaust duct 202 from the contents of the condenser 15 and other downstream components. Interior area 210 is defined as the area within the steam turbine 12 and steam turbine exhaust duct vent 206. Contaminated fluid 212 is defined as the fluid, typically air, within interior area 210 which is sought to be purged from the power plant. Steam turbine exhaust duct vent 206, which includes steam turbine exhaust duct vent valve 208, creates a path between the interior area 210 of the steam turbine exhaust duct 202, and a fluid sink 214, the fluid sink 214 being separate from the uncontaminated fluid present in the rest of the power generation plant 10. The location for the steam turbine exhaust duct vent 206 is determined to maximize the amount of contaminated fluid 212 that can be removed. In an embodiment, this will result in the steam turbine exhaust duct vent 206 being located immediately upstream of and proximate to the steam turbine exhaust duct isolation valve 204. Working fluid 216 is shown as a liquid in condensate receiver tank 24. Pressure maintaining fluid 218 is shown as a gas in the condenser 15. Pressure maintaining fluid 218 includes but is not limited to inert gasses, for example, nitrogen, argon, helium, or neon gas, etc.

Figure 2:
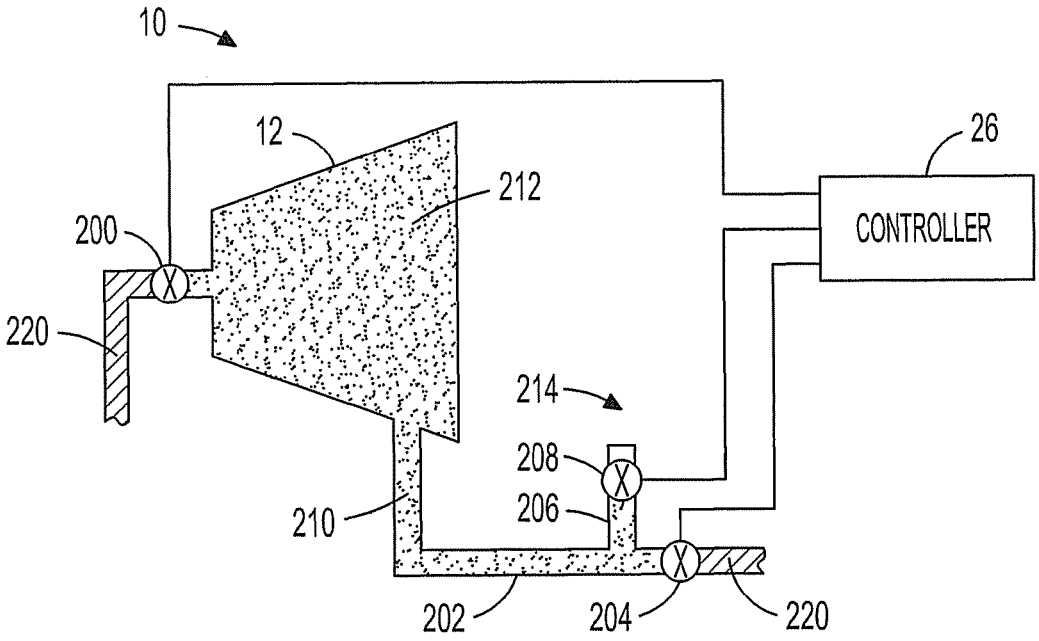
FIG. 2 shows the relevant portion of the power plant from FIG. 1, in a shut-down condition.

FIG. 2 shows the relevant portion of the power plant 10 including the steam turbine 12, contaminated fluid 212, steam turbine isolation valve 200, steam turbine exhaust duct 202, steam turbine exhaust duct isolation valve 204, steam turbine exhaust duct vent 206, steam turbine exhaust duct vent valve 208, interior area 210, and controller 26 from FIG. 2, as well as uncontaminated fluid 220, in the condition seen when the plant has been shut down. It can be seen that steam turbine isolation valve 200 and steam turbine exhaust duct isolation valve 204 have been closed, thus isolating contaminated fluid 212 within interior area 210 from the uncontaminated fluid 220 in the power generation plant 10. The uncontaminated fluid 220 may be working fluid 216, or it may be the pressure maintaining fluid 218, or it may be a mixture of the working fluid 216 and the pressure maintaining fluid 218. Contaminated fluid 212 remains inside the interior area 210, and a dryer removes moisture from this contaminated fluid 212 while the power generation plant 10 is shut down.

Figure 3:
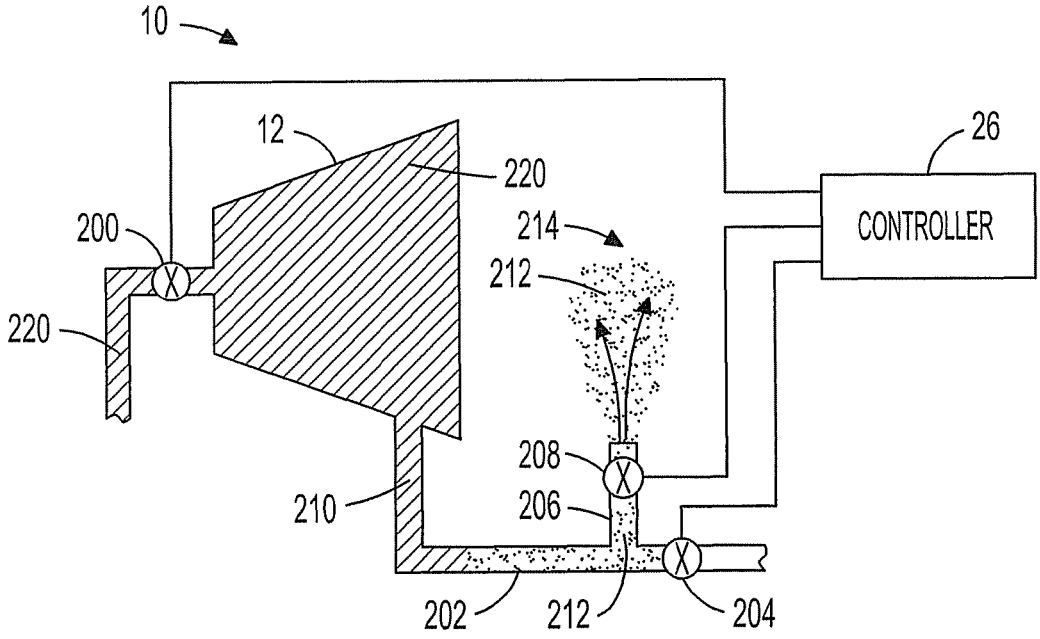
FIG. 3 shows the relevant portion of the power plant of FIG. 2, once the purging operation of the present invention has begun.

FIG. 3 shows the relevant portion of the power plant of FIG. 2, once the purging operation of the present invention has begun. The power generation plant 10 has begun to operate, steam turbine isolation valve 200 has been opened, and uncontaminated fluid 220 is delivered to the steam turbine 12 at a pressure above the pressure in the fluid sink 214. Initially some, but not all, of the contaminated fluid 212 in the steam turbine 15 will escape through gland steam drains (not shown). However, as the pressure in the turbine increases, a sufficient amount of contaminated fluid 212 will not be able to pass through the gland steam drains, leaving enough contaminated fluid 212 in the interior area 210 to present a concern about entrainment. As the process continues, steam turbine exhaust duct isolation valve 204 remains closed, and steam turbine exhaust duct vent valve 208 is opened, to release the contaminated fluid 212. The opening and closing of the valves can be manual, or controlled by controller 26. Contaminated fluid 212 is pushed by uncontaminated fluid 220 through the steam turbine 12, through the steam turbine exhaust duct 202, and out the steam turbine exhaust duct vent 206 to fluid sink 214. In an embodiment, the fluid sink 214 is the atmosphere.

Figure 4:
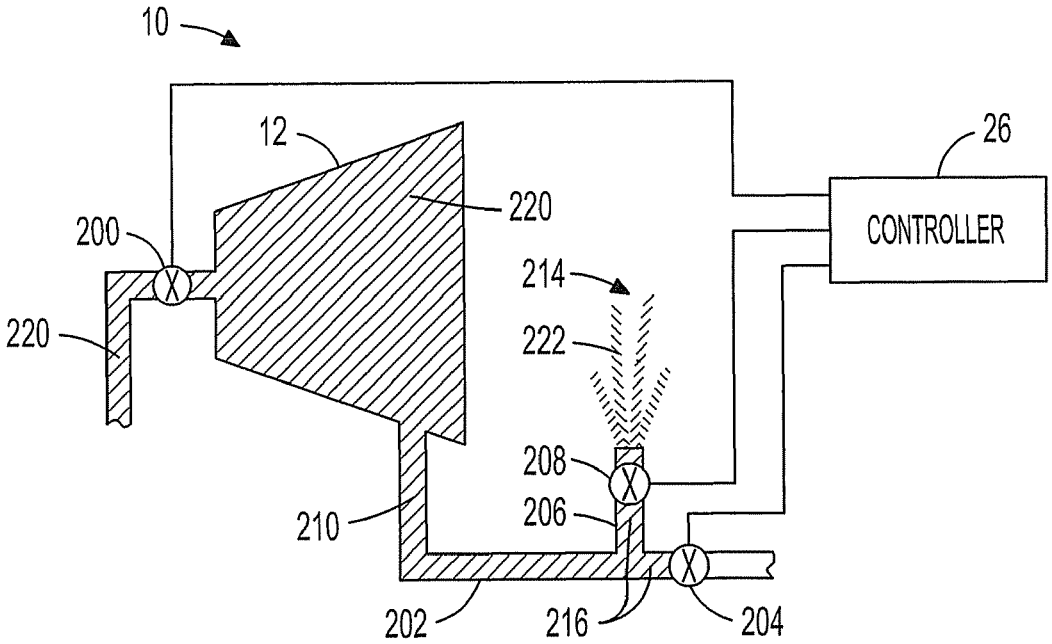
FIG. 4 shows the relevant portion of the power plant of FIG. 3, after the uncontaminated fluid has purged most, if not all, of the contaminated fluid in the relevant portion.

FIG. 4 shows the relevant portion of the power plant of FIG. 3, after uncontaminated fluid 220 has purged most, if not all, of contaminated fluid 212 to fluid sink 214. The amount of purging required can be based on various factors, including, but not limited to, how much purging is required to bring subsequent contamination of the uncontaminated fluid 220 by the contaminated fluid 212 that is still remains in interior area 210 under acceptable limits. At this point uncontaminated fluid 220 fills most, if not all, of interior area 210. It can be seen that a sacrificial portion 222 of the uncontaminated fluid 220 may also be lost to the fluid sink 214 in the process, but this volume is generally inconsequential if the timing of the process is appropriately controlled. It is also noted that steam turbine exhaust duct isolation valve 204 remains closed until the purging process has reached the point where sufficient contaminated fluid 212 has been purged to minimize or eliminate any concerns about contaminants entering the uncontaminated fluid 220.

Figure 5:
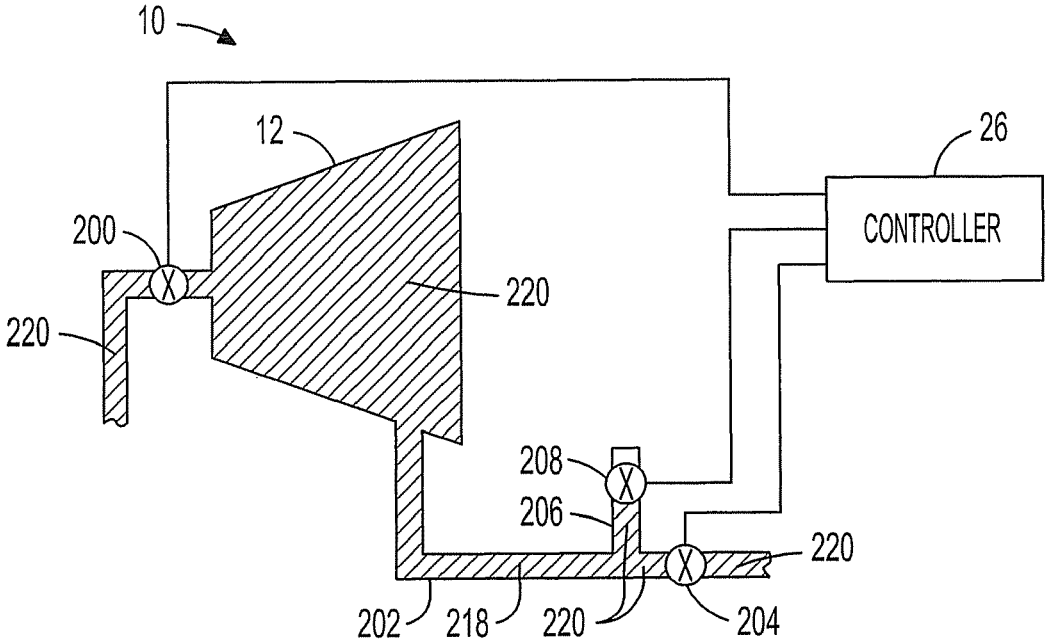
FIG. 5 shows the relevant portion of the power plant of FIG. 4, after the purging operation has been completed.

FIG. 5 shows the relevant portion of the power plant of FIG. 4, after the purging operation has been completed, steam turbine exhaust duct isolation valve 204 has been opened, steam turbine exhaust duct vent valve 208 has been closed, and the uncontaminated fluid 220 is delivered to the condenser 15 and the rest of the power plant. The opening and closing of the valves can be manual, or controlled by controller 26. At this point the purging operation has been completed, and the power plant can begin, continue with, or complete the remaining start-up procedures as necessary, using uncontaminated fluid 220 that has not been entrained with the contaminated fluid 212.

Thus, with this simple, yet innovative modification to a steam turbine power plant, the inventors have created a way to decrease the amount of treatment the working fluid in a positive pressure steam power plant may require at start up. This reduction in treatment may correspond to a reduction in start-up time for these steam power plants, and reduced start up time is of paramount importance to the success of these systems. The inventors have done this by adding simple, inexpensive components, which may be controlled by existing controllers.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A power plant comprising:

a steam turbine;

a steam turbine exhaust duct configured to deliver uncontaminated fluid from the steam turbine to downstream components of the power plant, the steam turbine exhaust duct comprising a steam turbine exhaust duct isolation valve selectively configured to prevent fluid communication between the steam turbine exhaust duct and the downstream components of the power plant; and a steam turbine exhaust duct vent further comprising an steam turbine exhaust duct vent valve, wherein the steam turbine exhaust duct vent is configured to deliver contaminated fluid from the steam turbine exhaust duct to a fluid sink upon opening of the steam turbine exhaust duct vent valve.

2. The power plant of claim 1, wherein the fluid sink is the atmosphere.

3. The power plant of claim 1, wherein the steam turbine exhaust duct vent is located proximate the steam turbine exhaust duct isolation valve.

4. In a power plant comprising a steam turbine, a steam turbine exhaust duct, and an steam turbine exhaust duct isolation valve selectively configured to prevent fluid communication between the steam turbine exhaust duct and the downstream components of the power plant, an improvement comprising a steam turbine exhaust duct vent connected between the steam turbine exhaust duct and a fluid sink at a location between the steam turbine and the steam turbine exhaust duct isolation valve.

5. The improvement of claim 4, wherein the fluid sink is the atmosphere.

6. The improvement of claim 4, wherein the steam turbine exhaust duct vent is located proximate the steam turbine exhaust duct isolation valve.

7. A method of removing contaminated fluid from a power plant when the power plant comprises a steam turbine isolation valve, a steam turbine, a steam turbine exhaust duct, a steam turbine exhaust duct isolation valve, a steam turbine exhaust duct vent leading to a fluid sink and further comprising a steam turbine exhaust duct vent valve, an interior area comprising interior areas within the steam turbine and exhaust duct, contaminated fluid located in the interior area, other components of the power plant, and uncontaminated fluid present in the other components of the power plant, wherein contaminated fluid within the interior area has been isolated from the uncontaminated fluid present within the other components of the power plant by the steam turbine isolation valve, the steam turbine exhaust duct isolation valve, and further isolated from the fluid sink by the steam turbine exhaust duct vent valve, the method comprising:

opening the steam turbine isolation valve to admit uncontaminated fluid into the steam turbine, thereby generating pressure within the interior area greater than pressure present in the fluid sink;

opening the steam turbine exhaust duct vent valve to permit the contaminated fluid to purge from the interior area to the fluid sink via the steam turbine exhaust duct vent; and closing the steam turbine exhaust duct vent valve and opening the steam turbine exhaust duct isolation valve when a sufficient amount of the contaminated fluid has been purged.

8. The method of claim 7, wherein the method further comprises purging of the contaminated fluid to the atmosphere.

* * * * *